United States Patent [19]

Bresson

[11] Patent Number: 4,511,465

[45] Date of Patent: Apr. 16, 1985

[54] ORE FLOTATION WITH COMBINED COLLECTORS

[76] Inventor: Clarence R. Bresson, c/o French, Hughes and Doescher P.O. Box 2443, Bartlesville, Okla. 74005

[21] Appl. No.: 619,254

[22] Filed: Jun. 11, 1984

[51] Int. Cl.[3] ..... B03D 1/14

[52] U.S. Cl. ..... 209/166; 252/61

[58] Field of Search ..... 209/166, 167; 252/61

[56] References Cited

U.S. PATENT DOCUMENTS 4,316,797 2/1982 Parlman ..... 209/166

4,462,898 7/1984 Parlman et al. ..... 209/166

*Primary Examiner*—Bernard Nozick

[57] ABSTRACT

A composition comprising a mixture containing both the following compounds in substantial quantities (a) S-allyl-S′-n-butyl trithiocarbonate; and (b) a compound selected from the group consisting of N,N,S-triethyl dithiocarbamate, N,N-diethyl-S-n-butyl dithiocarbamate, and mixtures thereof, is used for the flotation of molybdenum, copper, nickel, zinc and iron-containing ores.

23 Claims, No Drawings

ORE FLOTATION WITH COMBINED COLLECTORS

The present invention relates generally to mineral recovery by flotation operations. In one aspect the invention relates to a new composition comprising two flotation ingredients. In another aspect the invention relates to ore flotation processes, such as, for example, those processes involving recovery of copper, nickel, molybdenum, zinc and iron.

Flotation processes are used for recovering and concentrating minerals from ores. In froth flotation processes, the ore is crushed and wet ground to obtain a pulp. Additives, such as mineral flotation or collecting agents, frothers, depressants, stabilizers, etc., are added to the pulp to assist the separation of valuable materials from the undesired minerals or gangue portions of the ore in one or more subsequent flotation steps. The pulp is then aerated to produce a froth at the surface. The minerals which adhere to the bubbles or froth are skimmed or otherwise removed and the mineral-bearing froth is collected and further processed to recover the desired minerals. Other valuable minerals can be recovered from the tail product which is separated from the mineral-bearing froth during the flotation process. Typical mineral flotation collectors include xanthates, amines, alkyl sulfates, arenes, sulfonates, dithiocarbamates, dithiophosphates, trithiocarbonates and thiols.

U.S. Pat. No. 2,600,737 describes alkali metal salts of tertiary alkyl trithiocarbonates and processes for making such salts. This patent also describes the use of such compounds in ore flotation. Sodium diethyl dithiophosphate has also been described in other references as a collector in the separation of zinc and copper. The prior art has also described potassium ethyl xanthate and potassium isoamyl xanthate as ore flotation collectors for copper.

U.S. Pat. No. 4,341,715 discloses the synthesis of S-allyl-S'-n-butyl trithiocarbonate, and further discloses the use of such compound as a mineral sulfide collector in ore flotation. This patent does not mention the use of such compound with other collectors in an ore flotation process.

U.S. Pat. No. 4,316,797 discloses the use of trithocarbonates, such as, for example, S-allyl-S'-butyl trithiocarbonate, which are blended on a 1:1 weight ratio with $SO_2$ extract oil to produce a product which is useful as a mineral sulfide collector. This patent does not mention the employment of such a product blend with other collectors in an ore flotation process.

While the art of ore flotation has reached a significant degree of sophistication, it is a continuing goal in the ore recovery industry to increase the productivity of ore flotation processes and, above all, to provide specific processes which are selective to one ore or to one metal over other ores or other metals, respectively, which are present in the materials being treated in such processes.

It is thus one object of this invention to provide a new composition which is useful in ore flotation.

Another object of this invention is to provide an ore flotation process.

A further object of this invention is to provide an improved flotation process using new compositions to improve the recovery of copper and molybdenum.

A still further object of this invention is to provide a flotation process employing new compositions to improve the recovery of copper and nickel.

Yet another object of this invention is to provide a flotation process employing new compositions to improve the recovery of zinc.

These and other objects, advantages, details, features and embodiments of this invention will become apparent to those skilled in the art from the following detailed description of the invention and the appended claims.

In accordance with this invention it has been found that the recovery of copper, molybdenum, nickel and zinc is synergistically improved when S-allyl-S'-n-butyl trithiocarbonate and a composition selected from the group consisting of N,N,S-triethyl dithiocarbamate, N,N-diethyl-S-n-butyl dithiocarbamate, and mixtures thereof, are used together in a flotation process.

Thus, in accordance with the first embodiment of this invention, novel ore flotation compositions are provided. These novel ore flotation compositions include a mixture of substantial quantities of S-allyl-S'-n-butyl trithiocarbonate and a composition selected from the group consisting of N,N,S-triethyl dithiocarbamate, N,N-diethyl-S-n-butyl trithiocarbamate, and mixtures thereof.

A suitable allyl n-butyl trithiocarbonate for use in the present invention is designated S-allyl-S'-n-butyl trithiocarbonate, and is further characterized by the following structural formula

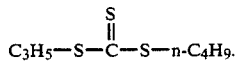

The N,N,S-triethyl dithiocarbamate suitable for use in the present invention is further characterized by the following structural formula

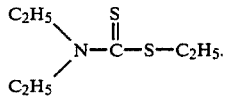

The N,N-diethyl-S-n-butyl dithiocarbamate suitable for use in the present invention is further characterized by the following structural formula

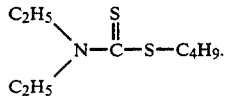

The two synergistically combined components of the novel ore flotation compositions of the present invention are preferably present in each composition in volume ratios in the range of from about 90:10 to about 10:90, and more preferably in the range from about 80:20 to about 20:80. Highly satisfactory results are obtained when the two synergistically acting components of the flotation agents of the present invention are present in roughly the same quantity by volume. In the more specific inventive blend of S-allyl-S'-n-butyl trithiocarbonate and N,N,S-triethyl dithiocarbamate, advantageous ore flotation results are obtained when the volume ratio of the two compounds fall generally in the range from about 65:35 to about 35:65.

The production of the asymmetrical S-allyl-S'-n-butyl trithiocarbonate is described in detail in U.S. Pat. No. 4,341,715.

In accordance with another embodiment of this invention, a flotation process is provided. This flotation process involves the steps of mixing mineral materials, water, and one of the inventive compositions described above to establish a pulp. This step is followed by aerating the thus established pulp to produce a froth and a tail product, separating the froth and the tail product and recovering mineral values from the froth. Minerals values can also be recovered from the tail product.

The process steps described above are conventional except for the use of a composition in accordance with the present invention as a collector as described. Although the individual compounds of the inventive composition described above can be added separately during the froth flotation operation, it is preferred that the composition comprising S-allyl-S'-n-butyl trithiocarbonate and a compound selected from the group consisting of N,N,S-triethyl dithiocarbamate, N,N-diethyl-S-n-butyl dithiocarbamate, and mixtures thereof, be premixed, blended or otherwise combined before using these novel compositions in an ore flotation process. While any amount of inventive collector blend can be employed in an ore flotation process which will achieve the desired results, such collector blend is generally employed in the range from about 0.001 to about 1 lb/ton of solid (ore or concentrate) or mineral materials, and is more preferably employed in the range from about 0.01 to about 0.5 lb/ton of solids or mineral materials.

It is generally believed that the inventive compositions disclosed herein are useful for separating any valuable metal from its corresponding gangue material. It is also understood that the inventive compositions can separate a mixture of metals that are contained in a particular mining deposit or ore, such mixture being further separated by subsequent froth flotations or any other conventional separating methods. Similarly, it will be understood that the inventive compositions can separate a mixture of metals that are contained in a concentrate such as a rougher concentrate in which a mining deposit or ore has been previously subjected to separation procedures such as ore flotation. The inventive compositions herein disclosed are particularly useful for separating copper, nickel, iron, zinc and molybdenum minerals from the total ore. Such molybdenum-bearing ores include, but are not limited to such materials as

| Molybdenum-Bearing ores: | |
|---|---|
| Molybdenite | $MoS_2$ |
| Wulfenite | $PbMoO_4$ |
| Powellite | $Ca(Mo,W)O_4$ |
| Ferrimolybdite | $Fe_2Mo_3O_{12}.8H_2O$. |

Other metal bearing ores within the scope of this invention are, for example, but not limited to, such materials as

| Copper-bearing ores: | |
|---|---|
| Covallite | $CuS$ |
| Chalcocite | $Cu_2S$ |
| Chalcopyrite | $CuFeS_2$ |
| Bornite | $Cu_5FeS_4$ |
| Cubanite | $Cu_2SFe_4S_5$ |

-continued

| | |
|---|---|
| Valerite | $Cu_2Fe_4S_7$ or $Cu_3Fe_4S_7$ |
| Enargite | $Cu_3(As,Sb)S_4$ |
| Tetrahedrite | $Cu_3SbS_2$ |
| Tennanite | $Cu_{12}As_4S_{13}$ |
| Cuprite | $Cu_2O$ |
| Tenorite | $CuO$ |
| Malachite | $Cu_2(OH)_2CO_3$ |
| Azurite | $Cu_3(OH)_2CO_3$ |
| Antlerite | $Cu_3SO_4(OH)_4$ |
| Brochantite | $Cu_4(OH)_6SO_4$ |
| Atacamite | $Cu_2Cl(OH)_3$ |
| Chrysocolla | $CuSiO_3$ |
| Famatinite | $Cu_3(Sb,As)S_4$ |
| Bournonite | $PbCuSbS_3$ |
| Lead-Bearing ore: | |
| Galena | $PbS$ |
| Antimony-Bearing ore: | |
| Stibnite | $Sb_2S_3$ |
| Zinc-Bearing ores: | |
| Sphalerite | $ZnS$ |
| Zincite | $ZnO$ |
| Smithsonite | $ZnCO_3$ |
| Silver-Bearing ores: | |
| Argentite | $Ag_2S$ |
| Stephanite | $Ag_5SbS_4$ |
| Hessite | $AgTe_2$ |
| Chromium-Bearing ores: | |
| Daubreelite | $FeSCrS_3$ |
| Chromite | $FeO.Cr_2O_3$ |
| Gold-Bearing ores: | |
| Sylvanite | $(AuAg)Te_2$ |
| Calaverite | $AuTe_2$ |
| Platinum-Bearing ores: | |
| Cooperite | $Pt(AsS)_2$ |
| Sperrylite | $PtAs_2$ |
| Uranium-Bearing ores: | |
| Pitchblende | $U_2O_5(U_3O_8)$ |
| Gummite | $UO_2.nH_2O$. |

The presently preferred ores in connection with which the process of this invention is applied are copper, molybdenum, nickel, zinc and iron ores or minerals.

Any froth flotation apparatus can be used in this invention. The most commonly used commercial flotation machines are the Agitar (Galigher Co.), Denver Sub-A (Denver Equipment Co.), and the Fagergren (Western Machinery Co.). Smaller laboratory scale apparatus such as the Hallimond cell can also be used.

The instant invention was demonstrated in tests conducted at ambient room temperature to about 37° C. (100° F.) and atmospheric pressure. However, any temperature or pressure generally employed by those skilled in the art is within the scope of this invention.

The following examples serve to illustrate this invention without undue limitation of the scope thereof.

EXAMPLE I

This example illustrates the synergism resulting when a blend of a trithiocarbonate and a dithiocarbamate is used as a Cu and Mo collector in an ore flotation process. The example also illustrates the wide variation in volume ratios that can be used with the blends and still be effective as a collector. The following procedure is typical of the methods used to evaluate the inventive blends. To a ball mill was added 1000 grams of an ore (Morenci #1) comprising by weight about 0.89% Cu, 0.009% Mo, 3.7–4.0% Fe along with 600 milliliters of water, 2.3 grams (4.6 lbs/ton) of CaO and 6 drops (0.04 lb/ton) of a 50:50 volume ratio blend of two oily collectors, namely, S-allyl-S'-n-butyl trithiocarbonate and N,N,S-triethyl dithiocarbamate and the mixture group for 18 minutes. Afterwards the slurry was transferred to a 2.5 Liter capacity Denver D-12 flotation cell along with enough water to make about a 30 weight percent slurry. Also added to the cell was 12 drops (0.08 lb/ton) of additional 50:50 blend plus 16 drops (0.1 lb/ton) of methyl isobutyl carbinol (MIBC) and the cell was conditioned for 1 minute at 1200 rpm and floated for 6 minutes. The concentrate was filtered, dried and analyzed. The procedure was repeated and an average weight percent recovery estimated. In this manner there was obtained average weight recoveries of 63.6 percent, Cu, 59.4 percent Mo, and 17.9 percent Fe. The procedure was again repeated but with various ratio blends and with each collector ingredient by itself. These data are listed in Table I and show that ratio blends varying between 80:20 to 20:80 give significant increases in Cu and Mo recoveries with only a slight increase in Fe recoveries compared to when each collector is used by itself (runs 1 and 7). The data suggest the optimum ratio range is between about 65:35 to 35:65 S-allyl-S'-n-butyl trithiocarbonate:N,N,S-triethyl dithiocarbamate.

TABLE I

Effect of Trithiocarbonate-Dithiocarbamate Blends on the Ore Flotation, of Cu, Mo, Fe
Morenci Ore, 1000 grams
0.89% Cu; 0.009% Mo; 3.85% Fe

| Run No. | Vol. % Collector, 0.12 lb/ton: Trithio-carbonate[a] | Dithio-carbamate[b] | Av. Wt. % Recovery: Cu | Mo | Fe |
|---|---|---|---|---|---|
| 1 | 100 | 0 | 61.5 | 56.4 | 17.0 |
| 2 | 80 | 20 | 63.1 | 59.4 | 17.4 |
| 3 | 65 | 35 | 63.7 | 60.4 | 18.8 |
| 4 | 50 | 50 | 63.6 | 59.4 | 17.9 |
| 5 | 35 | 65 | 61.5 | 61.0 | 16.1 |
| 6 | 20 | 80 | 63.6 | 60.5 | 18.4 |
| 7 | 0 | 100 | 59.8 | 56.1 | 15.1 |

[a]S—Allyl-S'—n-Butyl Trithiocarbonate
[b]N,N,S—Triethyl Dithiocarbamate

EXAMPLE II

This example illustrates the effectiveness of a similar trithiocarbonate-dithiocarbamate blend wherein the dithiocarbamate is a higher homolog than that previously described in Example I, namely, N,N-diethyl-S-n-butyl dithiocarbamate. Repeating the procedure described in Example I but using a blend based on 50 volume percent N,N-diethyl-S-n-butyl dithiocarbamate:50 volume percent S-allyl-S'-n-butyl trithiocarbonate, again resulted in a synergistic increase over the use of the trithiocarbonate component along in the Mo recovery, with no increase in the Cu or Fe recoveries. However, the blend provided an increase in Mo, Cu and Fe recoveries over the use of the dithiocarbamate component alone. It is significant to note that the inventive blend is shown in general to enhance Mo and Cu recovery relative to Fe recovery. The data indicates the blend as useful in ore flotation but not as effective as the N,N,S-triethyl dithiocarbamate-based blend in Example I.

TABLE II

Effect of Trithiocarbonate-Dithiocarbamate Blends on the Ore Flotation, of Cu, Mo, Fe
Morenci Ore, 1000 grams
0.89% Cu; 0.009% Mo; 3.85% Fe

| Run No. | Vol. % Collector, 0.12 lb/ton: Trithio-carbonate[a] | Dithio-carbamate[b] | Av. Wt. % Recovery: Cu | Mo | Fe |
|---|---|---|---|---|---|
| 1 | 100 | 0 | 61.5 | 56.4 | 17.0 |
| 2 | 50 | 50 | 59.0 | 58.6 | 13.4 |
| 3 | 0 | 100 | 50.3 | 50.7 | 9.3 |

[a]S—Allyl-S'—n-Trithiocarbonate
[b]N,N—Diethyl-S—n-Butyl Dithiocarbamate

EXAMPLE III

This example illustrates the effectiveness of the inventive blend to enhance the recovery of Cu from another ore source. The procedure described in Example I was basically repeated but with different control collectors and a different ore source, namely, Falconbridge ore comprised of 0.9 weight percent Cu, 1.19 weight percent Ni and 24.0 percent Fe. These results listed in Table III show the inventive blend of S-allyl-S'-n-butyl trithiocarbonate:N,N,S-triethyl dithiocarbamate when employed at a 1:1 volume ratio significantly increases the average weight percent Cu recovery compared to when the inventive collector components are used separately. Advantages of the inventive blend for Ni and Fe recoveries is not seen in these tests. However, the inventive blend provides selective flotation of Cu relative to both Fe and Ni.

TABLE III

Effect of Trithiocarbonate-Dithiocarbamate Blend as a Mineral collector in Ore Flotation
750 grams Falconbridge Ore
300 mL $H_2O$, 0.65 gram Lime

| Run No. | Collector | lb/ton | Frother[a] lb/ton | Wt. % Recovery: Cu | Ni | Fe |
|---|---|---|---|---|---|---|
| 1 | Sodium Isopropyl Xanthate[b] | .008 | .034 | 64.7 | 9.6 | 6.5 |
| | | | | 50.5 | 10.1 | 7.2 |
| | | | Av. = | 57.6 | 9.9 | 6.9 |
| 2 | Trithiocarbonate[c] | .15 | .102 | 59.3 | 18.3 | 12.7 |
| | | | | 54.8 | 15.2 | 12.4 |
| | | | Av. = | 57.1 | 16.8 | 12.6 |
| 3 | Sodium Isopropyl Xanthate[b] | .008 | .034 | 72.5 | 28.2 | 13.4 |
| | N,N,S—Triethyl Dithiocarbamate | .15 | | 76.0 | 36.2 | 16.7 |
| | | | Av. = | 74.3 | 32.2 | 15.1 |
| | Invention: | | | | | |
| 4 | Sodium Isopropyl Xanthate[b] | .008 | .102 | 76.9 | 24.1 | 14.8 |
| | Trithiocarbonate | .075 | | 78.3 | 24.2 | 15.2 |

TABLE III-continued

Effect of Trithiocarbonate-Dithiocarbamate Blend as a Mineral collector in Ore Flotation 750 grams Falconbridge Ore 300 mL $H_2O$, 0.65 gram Lime

| Run No. | Collector | lb/ ton | Frother[a] lb/ton | Wt. % Recovery Cu | Ni | Fe |
|---|---|---|---|---|---|---|
| | N,N,S—Triethyl Dithiocarbamate | .075 | Av. = | 77.6 | 24.2 | 15.0 |

[a]Dowfroth 250
[b]1 Wt. % Aqueous solution
[c]S—Allyl-S'—n-Butyl Trithiocarbonate

EXAMPLE IV

This example illustrates the effectiveness of a 50:50 volume ratio blend of S-allyl-S'-n-butyl trithiocarbonate and N,N,S-triethyl dithiocarbamate when used with a Zn-containing concentrate. To a 1.25 Liter capacity Denver flotation cell was added about 755 grams of a coarsely ground filtered Zn concentrate containing about 10 weight percent water (Jersey Minere). Additional fresh water was added to about half way up from the cell bottom along with 15.8 milliliters of a 1.49 weight percent aqueous $CuSO_4$ solution (0.70 lb/ton dry ore) and conditioned for 7 minutes at 1400 rpm. During this time 3 drops of a polyglycol frother (AF-65, 0.030 lb/ton) was added. At the end of this conditioning period 7 drops (0.0032 grams/drop or about 0.07 lb/ton) of a 50:50 blend of S-allyl-S'-n-butyl trithiocarbonate:N,N,S-triethyl dithiocarbamate was added to the slurry and conditioned for 5 minutes at 1400 rpm. The pulp was then floated for 6 minutes and the froth skimmed in 30 second intervals. Two more drops (0.02 lb/ton) of the blend was again added and a second float carried out for 5 minutes. The two floats (concentrates) were combined, filtered, dried and analyzed. The procedure was repeated for duplication. A control was also carried out employing sodium diisopropyl dithiophosphate as the collector. These results are listed in Table IV which shows the inventive blend almost doubling the Zn recovery compared to the commercial dithiophosphate collector. The Fe recovery also increases with the blend but is not considered detrimental since the purity or amount of Fe relative to the Zn remains the same in both cases.

TABLE IV

Effect of Trithiocarbonate-Dithiocarbamate Blend as a Zn Collector in Ore Flotation Jersey Minere Zn Concentrate

| Run | Collector, 0.09 lb/ton | Wt. % Recovery Zn | Fe |
|---|---|---|---|
| | Control: | | |
| 1 | Dithiophosphate[a] | 46.8 | 11.3 |
| 2 | " | 38.6 | 10.3 |
| 3 | " | 45.7 | 11.1 |
| | Average = | 43.7 | 10.9 |
| | Invention: | | |
| 4 | Trithiocarbonate-Dithiocarbamate[b] | 80.8 | 19.7 |
| 5 | Trithiocarbonate-Dithiocarbamate[b] | 83.2 | 19.9 |
| | Average = | 82.0 | 19.8 |

[a]Sodium diisopropyl dithiophosphate, AC 211, from American Cyanamid
[b]50:50 Vol. % blend of S—allyl-S'—n-butyl trithiocarbonate: N,N,S—triethyl dithiocarbamate Reasonable variations and modifications which will become apparent to those skilled in the art can be made in this invention without departing from the spirit and scope thereof.

I claim:

1. A composition comprising a mixture which contains both of the following compounds in substantial quantities (a) S-allyl-S'-n-butyl trithiocarbonate; and (b) a compound selected from the group consisting of N,N,S-triethyl dithiocarbamate, N,N-diethyl-S-n-butyl dithiocarbamate, and mixtures thereof.

2. A composition in accordance with claim 1 wherein the volume ratio of the volume of compound (a) to the volume of compound (b) is in the range from about 80:20 to about 20:80.

3. A composition in accordance with claim 1 characterized further to include a quantity of water.

4. A composition in accordance with claim 1 wherein the volume ratio of the volume of compound (a) to the volume of compound (b) is in the range from about 90:10 to about 10:90.

5. An ore flotation process comprising:

mixing mineral material, water and a composition as defined in claim 4 to establish a pulp;

aerating said thus established pulp to produce a froth and a tail product;

separating said froth and said tail product; and recovering mineral values from said froth.

6. An ore flotation process in accordance with claim 5 characterized further to include:

recovering mineral values from said tail product.

7. An ore flotation process in accordance with claim 5 wherein said composition comprising compounds (a) and (b) is employed in a quantity in the range from about 0.001 to about 1 lb/ton of mineral material.

8. A composition in accordance with claim 1 wherein compound (b) consists essentially of N,N,S-triethyl dithiocarbamate.

9. An ore flotation process comprising:

mixing mineral material, water and a composition as defined in claim 8 to establish a pulp;

aerating said thus established pulp to produce a froth and a tail product;

separating said froth and said tail product; and recovering mineral values from said froth.

10. An ore flotation process in accordance with claim 9 wherein the volume ratio of compound (a) to compound (b) is in the range from about 90:10 to about 10:90, and wherein said composition comprising compounds (a) and (b) is employed in a quantity in the range from about 0.001 to about 1 lb/ton of mineral material.

11. A composition in accordance with claim 1 wherein compound (b) consists essentially of N,N,-diethyl-S-n-butyl dithiocarbamate.

12. An ore flotation process comprising:

mixing mineral material, water and a composition as defined in claim 11 to establish a pulp;

aerating said thus established pulp to produce a froth and a tail product;

separating said froth and said tail product; and recovering mineral values from said froth.

13. An ore flotation process in accordance with claim 12 wherein the volume ratio of compound (a) to compound (b) is in the range from about 90:10 to about 10:90, and wherein said composition comprising compounds (a) and (b) is employed in a quantity in the range from about 0.001 to about 1 lb/ton of mineral material.

14. An ore flotation process comprising:

mixing mineral material, water and a composition as defined in claim 1 to establish a pulp;

aerating said thus established pulp to produce a froth and a tail product;

separating said froth and said tail product; and recovering mineral values from said froth.

15. An ore flotation process in accordance with claim 14 characterized further to include:

recovering mineral values from said tail product.

16. An ore flotation process in accordance with claim 14 wherein said mineral material comprises crushed ore.

17. An ore flotation process in accordance with claim 14 wherein said mineral material comprises a mineral concentrate.

18. An ore flotation process in accordance with claim 14 wherein said composition comprising compounds (a) and (b) is employed in a quantity in the range from about 0.001 to about 1 lb/ton of mineral material.

19. An ore flotation process in accordance with claim 14 wherein said composition comprising compounds (a) and (b) is employed in a quantity in the range from about 0.001 to about 0.5 lb/ton of mineral material.

20. An ore flotation process in accordance with claim 14 wherein said mineral material comprises copper, molybdenum and iron.

21. An ore flotation process in accordance with claim 14 wherein said mineral material comprises copper, nickel and iron.

22. An ore flotation process in accordance with claim 14 wherein said mineral material comprises zinc and iron.

23. An ore flotation process in accordance with claim 14 wherein the volume ratio of the volume of compound (a) to the volume of compound (b) is in the range from about 80:20 to about 20:80, and wherein said composition comprising compounds (a) and (b) is employed in a quantity in the range from about 0.01 to about 0.5 lb/ton of mineral material.

* * * * *

UNITED STATES PATENT AND TRADEMARK OFFICE

CERTIFICATE OF CORRECTION

PATENT NO. : 4,511,465

DATED : April 16, 1985

INVENTOR(S) : Clarence R. Bresson

It is certified that error appears in the above-identified patent and that said Letters Patent is hereby corrected as shown below:

Please add to the first page of the patent the following:

Assignee: Phillips Petroleum Company
Bartlesville, Okla.

Signed and Sealed this

*Twenty-fifth* Day of *February 1986*

[SEAL]

*Attest:*

DONALD J. QUIGG

*Attesting Officer*

*Commissioner of Patents and Trademarks*